US005547444A

United States Patent [19]

Huang

[11] Patent Number: 5,547,444

[45] Date of Patent: Aug. 20, 1996

[54] MULTIPURPOSE EXERCISE DEVICE

[76] Inventor: Ching-Lien Huang, 2F, No. 14, Ning Hsia E. 5 St., Taichung, Taiwan

[21] Appl. No.: 547,155

[22] Filed: Oct. 24, 1995

[51] Int. Cl.[6] ..... A63B 21/00

[52] U.S. Cl. ..... 482/72; 482/95; 482/96

[58] Field of Search ..... 482/71, 72, 95, 482/96, 57, 131, 907; D21/191–196

[56] References Cited

U.S. PATENT DOCUMENTS

| | | | |
|---|---|---|---|
| D. 174,738 | 5/1955 | Cowgill | 482/72 |
| D. 218,624 | 9/1970 | Margolies | 482/95 |
| D. 329,672 | 9/1992 | Shieh | D21/195 |
| 641,596 | 1/1900 | Kerns | 482/72 |
| 2,173,691 | 9/1939 | Marlowe | 472/110 |
| 2,714,507 | 8/1955 | Goodrich | 482/72 |
| 3,446,503 | 5/1969 | Lawton | 482/95 |
| 4,300,760 | 11/1981 | Bobroff | 482/95 |
| 4,452,448 | 6/1984 | Ausherman | 482/72 |
| 4,930,769 | 6/1990 | Nenoff | 482/96 |
| 5,470,295 | 11/1995 | Wang | 482/96 |

*Primary Examiner*—Jerome Donnelly
*Attorney, Agent, or Firm*—Browdy and Neimark

[57] ABSTRACT

A multipurpose exercise device comprises a frame, a transmission mechanism and two rocking rod members. The frame has a slanted rod provided thereon with a sliding member. The transmission mechanism comprises a first support rod, a horizontal connection rod, and a second support rod. The first support rod is fastened pivotally with the sliding member and the horizontal connection rod. The second support rod is fastened with the horizontal connection rod and is provided with a pivoting lug engageable with a pivot for locating the second support rod. The rocking rod members are mounted respectively on both ends of the horizontal connection rod such that the rocking rod members can be pulled or pushed. The transmission mechanism is provided with an elastic block enabling the multipurpose exercise device to be used interchangeably for doing various exercises.

3 Claims, 3 Drawing Sheets

MULTIPURPOSE EXERCISE DEVICE

FILED OF THE INVENTION

The present invention relates generally to an exercise device, and more particularly to a multipurpose exercise device.

BACKGROUND OF THE INVENTION

The prior art rowing exercise device is generally provided with the oil-pressure cylinders serving as a damping device enabling an exerciser to do a rowing exercise. The cost of making such a rowing exercise device of the prior art is relatively high. In addition, the damping effect of the prior art rowing exercise device can not be adjusted in accordance with the individual requirements of an exerciser using the device. Some of the prior art multipurpose exercise devices are provided with means enabling an exerciser to do the rowing exercise; nevertheless these prior art multipurpose exercise devices are rather expensive and can not be easily adjusted for doing the rowing exercise.

SUMMARY OF THE INVENTION

It is therefore the primary objective of the present invention to provide a multipurpose exercise device which can be used interchangeably for doing various exercises.

It is another objective of the present invention to provide a multipurpose exercise device with a damping mechanism which can be easily adjusted in damping direction and magnitude in accordance with the requirements of an exerciser using the exercise device.

The foregoing objectives of the present invention are attained by the multipurpose exercise device, which comprises mainly a frame, a transmission mechanism, and two rocking rod members. The frame has a slanted rod provided thereon with a sliding member capable of being caused by an external force to slide. The transmission mechanism comprises a first support rod, a horizontal connection rod, and a second support rod. The first support rod is fastened pivotally with the sliding member. The horizontal connection rod is located under the first support rod such that the horizontal connection rod is connected at the center thereof with the bottom end of the first support rod. The second support rod is fastened with the horizontal connection rod and provided with an inverted U-shaped pivoting lug engageable with a pivot for locating the second support rod. Two rocking rod members are mounted respectively on both ends of the horizontal connection rod such that the rocking rod members can be pulled or pushed. The transmission mechanism is provided at the front end or the rear end thereof with an elastic block for enabling the exercise device to be used for doing a rowing exercise, a chest building exercise, a leg building exercise, a waist building exercise, etc.

The foregoing objectives, features, functions and advantages of the present invention will be more readily understood upon a thoughtful deliberation of the following detailed description of the present invention in conjunction with the accompanying drawings.

DETAILED DESCRIPTION OF THE INVENTION

Figure 1:
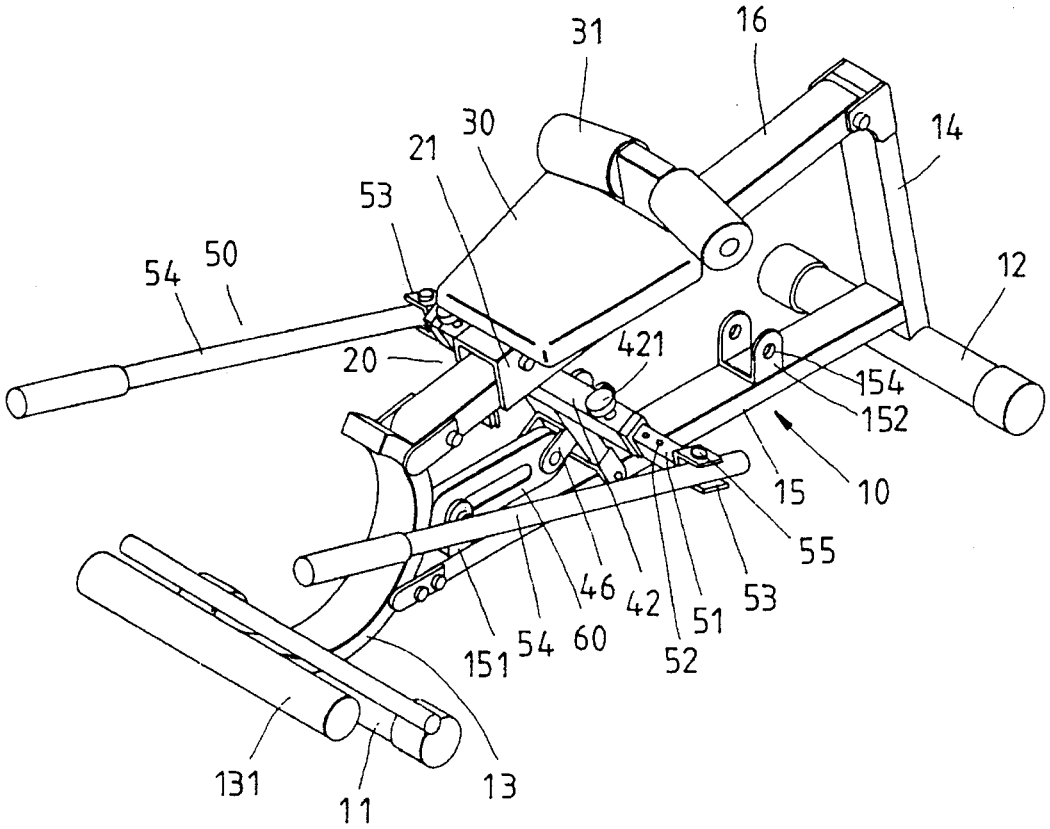
FIG. 1 shows a perspective view of the present invention.
Figure 2:
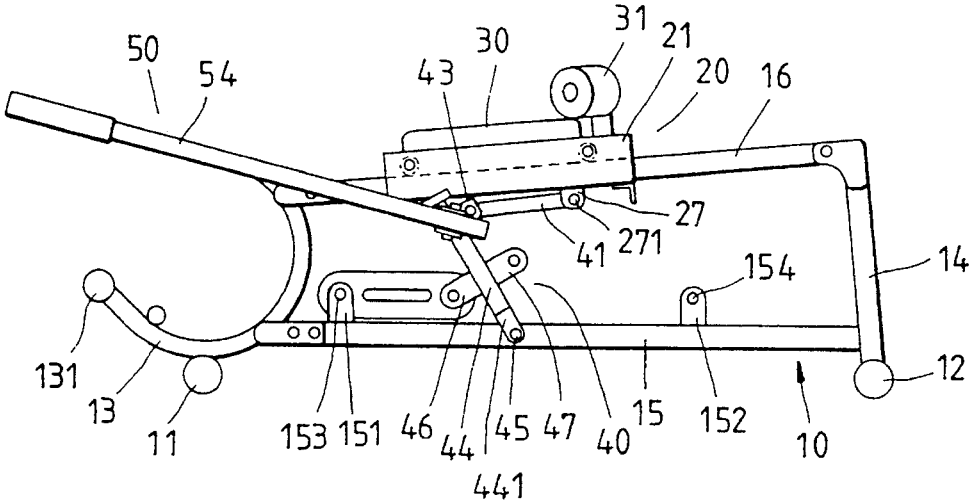
FIG. 2 is a side view of the present invention showing that the elastic block is located at the front end of the transmission mechanism.
Figure 3:
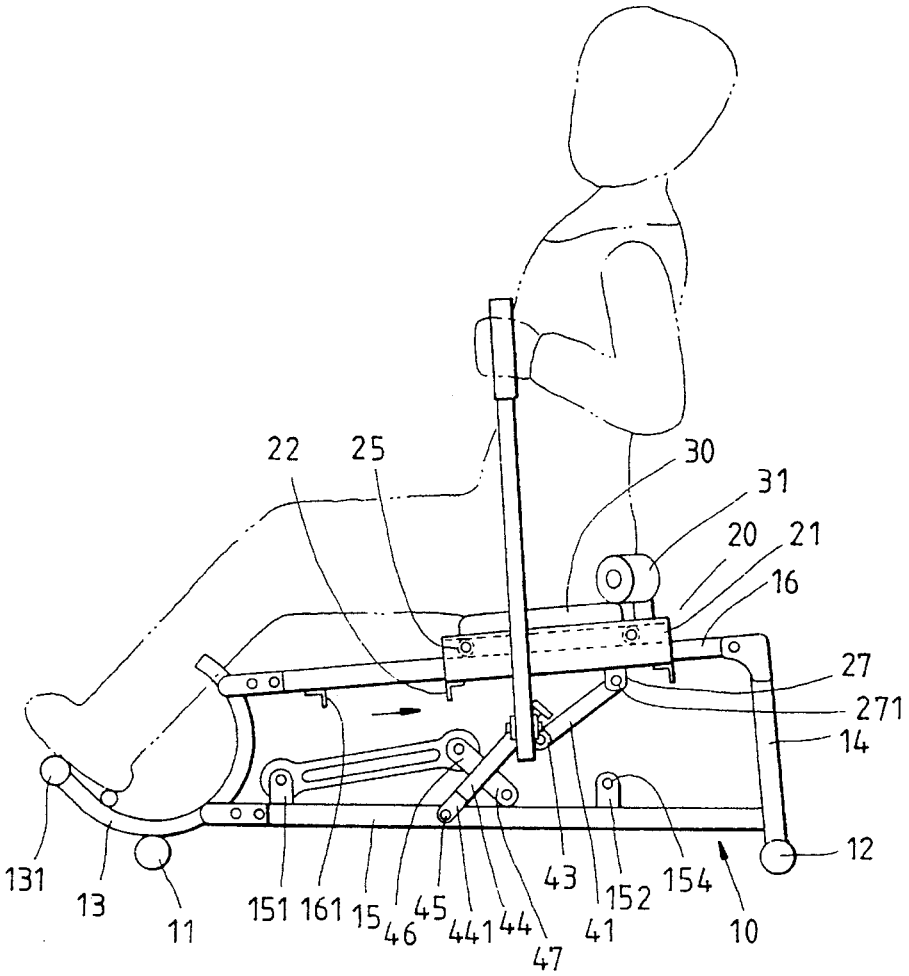
FIG. 3 is a schematic view showing that the present invention is used for doing a pushing exercise.

As show in FIGS. 1–3, the exercise device of the present invention comprises the component parts which are described hereinafter.

A frame 10 has a front cross tube 11, a rear cross tube 12, a front curved rod 13, and a rear upright rod 14. The front curved rod 13 is provided on the outer free end thereof with a pedal rod 13 1. The rear upright rod 14 has a top end which is located over the inner free end of the front curved rod 13. A connection rod 15 is connected at both ends thereof with the front curved rod 13 and the rear upright rod 14 and is provided With two U-shaped pivoting lugs 151 and 152, which are in turn provided coaxially with through holes 153 and 154. A slanted rod 16 is connected with the front curved rod 13 and is provided at the front end thereof with a stopping piece 161.

A sliding member 20 is slidably mounted on the slanted rod 16 and is composed of a frame body 21 of a rectangular construction, an arresting piece 22 engageable with the stopping piece 161, two rolling members 25 for enabling the frame body 21 to slide on the slanted rod 16, and an inverted U-shaped pivoting lug 27 having two wings provided axially with through holes 271.

A seat 30 is mounted on the frame body 21 and is provided with two waist rests 31.

A transmission mechanism 40 is mounted between the connection rod 15 and the slanted rod 16 and is composed of a first support rod 41 engaged with the pivoting lug 27 by means of a pin passing through the through hole 271. The transmission mechanism 40 is further composed of a horizontal connection rod 42 and a second support rod 44. The horizontal connection rod 42 is located under the first support rod 41 and pivotally connected thereto and is provided centrally with a U-shaped lug 43 engageable with the bottom end of the first support rod. The horizontal connection rod 42 is provided with two pivoting buttons 421. The second support rod 44 is fastened at the top end thereof with the center of the horizontal connection rod 42 and is provided at the bottom end thereof with an inverted U-shaped pivoting lug 441 for engaging pivotally with the connection rod 15 by means of a pivot 45. The second support rod 44 can be caused to swing forward or backwards in relation to the connection rod 15. The second support rod 44 is provided oppositely with two pivoting lugs 46 and 47.

Two rocking rods members (50) each include an insertion tube (51), a pivot (55) a lug (53) and a rock rod (54). The rocking rod members 50 are mounted at both ends of the horizontal connection rods 42 and are provided respectively with an insertion tube 51 engageable with the horizontal connection rod 42 and having axially a plurality of through holes 52 engageable with the pivoting buttons 421. The insertion tube 51 is provided with a lug 53 engageable pivotally with a rock rod 54 by means of a pivot 55.

An elastic block 60 of a rubber material is disposed on the pivoting lug 46 or the pivoting lug 47 of the second support rod 44 such that one end of the elastic block 60 is received in the pivoting lug 151 or 152.

Figure 4:
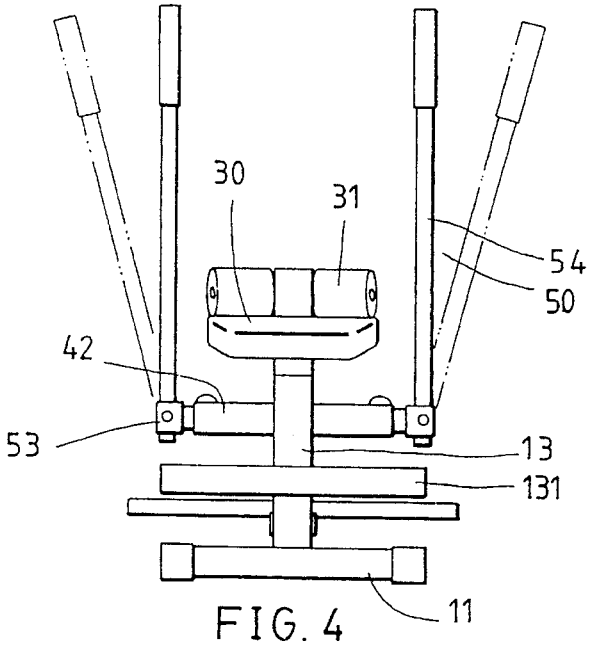
FIG. 4 is a schematic view showing that the present invention is used for doing a rowing exercise.

When the elastic block 60 is engaged with the pivoting lug 46 of the second support rod 44 and the pivoting lug 151 of the connection rod 15, the rocking rod members 50 are slanted toward the from curved rod 13. The exerciser sitting on the seat 30 can hold the two rock rods 54 and tread on the pedal rod 13 1 before pulling two rock rods 54 to cause the rocking rod members 50 to actuate the transmission mechanism 40 so as to overcome the damping force of the elastic block 60. In the meantime, the sliding member 20 is caused to slide on the slanted rod 16. As the sliding member 20 has reached the rear end the slanted rod 16, the rock rods 54 are rowed outward to cause the elastic block 60 to force the sliding member 20 to slide back to the initial point so as to complete a rowing exercise, as illustrated in FIGS. 3 and 4. The device of the present invention can be used interchangeably for doing a chest building exercise by pushing two rock rods 54 upward and outward in a parallel manner. The exerciser can do a leg exercise by treading on the pedal rod 131.

Figure 5:
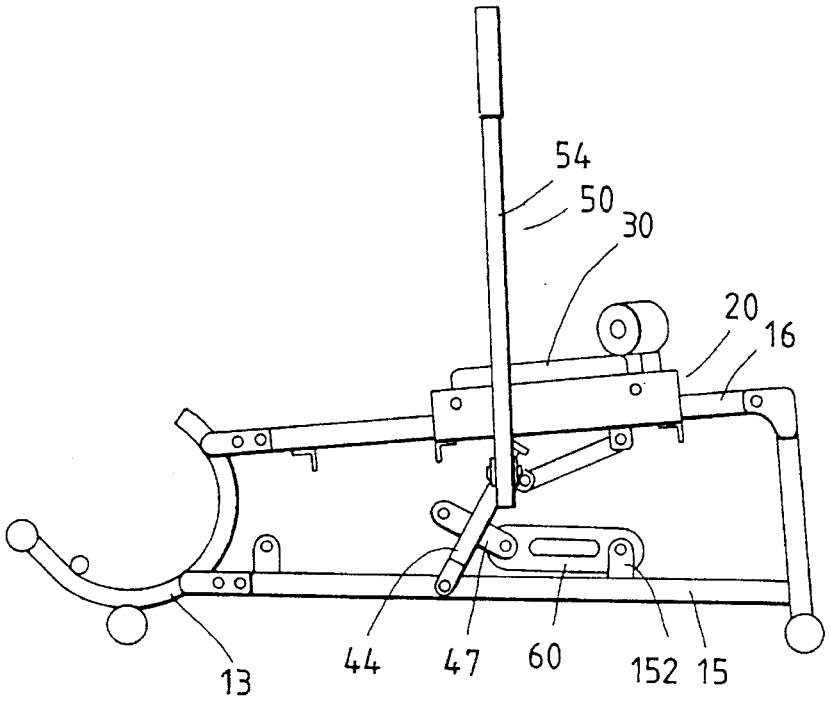
FIG. 5 is a side view showing that the elastic block is located at the rear end of the transmission mechanism of the present invention.
Figure 6:
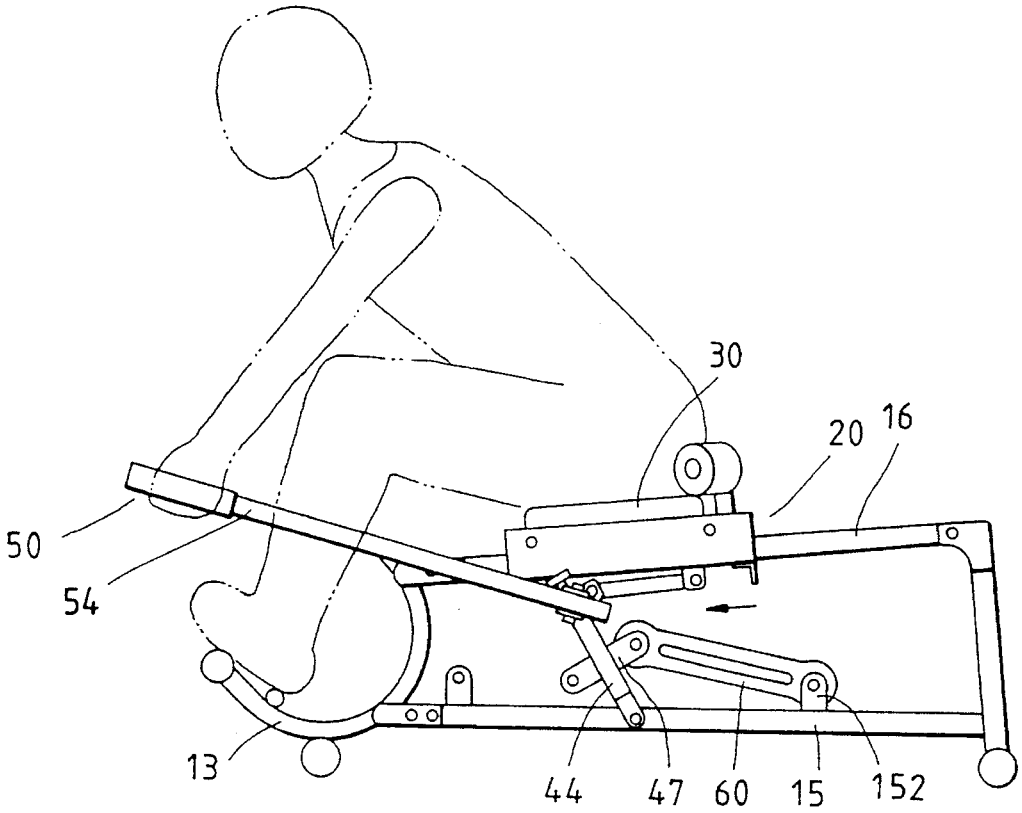
FIG. 6 is a schematic view showing that the present invention is used for doing a pulling exercise.

As illustrated in FIGS. 5 and 6, the elastic block 60 is engaged with the pivoting lug 47 of the second support rod 44 and the pivoting lug 152 of the connection rod 15. An exerciser is first seated on the seat 30 before holding the rock rods 54. As the rock rods 54 are pushed in the direction toward the front curved rod 13, the sliding member 20 id actuated to slide. As soon as the rock rods 54 are relieved of the force exerting thereon, the transmission mechanism 40 and the rocking rods 50 are forced back to the initial positions by the reaction force of the elastic block 60 so as to complete a waist exercise. The damping effect of the exercise device of the present invention can be easily adjusted by using one or more elastic blocks 60. In addition, the exercise device of the present invention can be used interchangeably for doing different exercises by changing the location of the elastic block 60.

What is claimed is:

1. A multipurpose exercise device, which comprises:

a frame including a connection rod having a connection rod front end and a connection rod rear end, a front curved rod attached to the connection rod front end, a front cross tube attached to the front curved rod, a rear upright rod attached to the connection rod rear end, a rear cross tube attached to the rear upright rod, and a slanted rod attached between the rear upright rod and the front curved rod;

a sliding member mounted slidably on said slanted rod of said frame;

a seat mounted on said sliding member;

a transmission mechanism disposed in a space defined by said frame;

two rocking rod members fastened with said transmission mechanism; and at least one elastic means for providing a damping effect;

wherein said connection rod is provided with two pivoting lugs having coaxially through holes;

wherein said transmission mechanism comprises a first support rod fastened pivotally at one end with said sliding member, a horizontal connection rod pivotally connected with said first support rod at another end thereof, and a second support rod fastened at one end thereof with said horizontal connection rod and fastened pivotally at another end thereof with said connection rod, said second support rod having two pivoting lugs;

wherein said rocking rods members are fastened with said horizontal connection rod of said transmission mechanism; and wherein said elastic means is engageable with said pivoting lugs of said connection rod and the pivoting lugs of said second support rod for providing various damping effects.

2. The exercise device as defined in claim 1, wherein said rocking rod members are provided respectively with an insertion tube engageable with said horizontal connection rod and having a pivoting lug, said rocking rod member further provided respectively with a rock rod fastened pivotally with said pivoting lug of said insertion tube.

3. The exercise device as defined in claim 1, wherein said sliding member comprises a frame body and two rolling members fastened with said frame body such that said sliding member can be caused to slide back and forth on said slanted rod of said frame.

* * * * *